US007975492B2

(12) United States Patent
Alahyari

(10) Patent No.: US 7,975,492 B2
(45) Date of Patent: Jul. 12, 2011

(54) THERMOELECTRIC COOLING FOR A REFRIGERATED DISPLAY CASE

(75) Inventor: Abbas A. Alahyari, Manchester, CT (US)

(73) Assignee: Carrier Corporation, Farmington, CT (US)

( * ) Notice: Subject to any disclaimer, the term of this patent is extended or adjusted under 35 U.S.C. 154(b) by 726 days.

(21) Appl. No.: 11/990,368

(22) PCT Filed: Aug. 12, 2005

(86) PCT No.: PCT/US2005/028744
§ 371 (c)(1),
(2), (4) Date: Feb. 12, 2008

(87) PCT Pub. No.: WO2007/021267
PCT Pub. Date: Feb. 22, 2007

(65) Prior Publication Data

US 2009/0288423 A1 Nov. 26, 2009

(51) Int. Cl.
*F25B 21/02* (2006.01)

(52) U.S. Cl. ..... 62/3.6; 62/249; 62/332

(58) Field of Classification Search ..... 62/3.2, 62/3.6, 246–256, 332, 344, 347, 457.9; 136/206
See application file for complete search history.

(56) References Cited

U.S. PATENT DOCUMENTS

| | | | | |
|---|---|---|---|---|
| 3,324,676 | A * | 6/1967 | Gerweck | 62/256 |
| 4,145,893 | A * | 3/1979 | Vogel | 62/151 |
| 4,326,385 | A * | 4/1982 | Ibrahim | 62/82 |
| 4,764,193 | A * | 8/1988 | Clawson | 62/3.3 |
| 4,964,281 | A * | 10/1990 | Tanaka | 62/256 |
| 6,003,319 | A | 12/1999 | Gilley et al. | 62/3.7 |
| 6,293,107 | B1 | 9/2001 | Kitagawa | 62/3.6 |
| 6,412,286 | B1 | 7/2002 | Park et al. | 62/3.6 |
| 6,612,116 | B2 | 9/2003 | Fu et al. | 62/3.6 |
| 2004/0069002 | A1 * | 4/2004 | Chuang et al. | 62/256 |

OTHER PUBLICATIONS

International Search Report issued Dec. 20, 2005 for PCT/US2005/028744.

* cited by examiner

*Primary Examiner* — Frantz F Jules
*Assistant Examiner* — Lukas Baldridge
(74) *Attorney, Agent, or Firm* — Cantor Colburn LLP

(57) ABSTRACT

A refrigerated display case (10) is provided with an open face (25) and an air flow (30) across the open face (25), which is cooled by a primary refrigeration system (20) and a thermoelectric heat pump (60).

11 Claims, 4 Drawing Sheets

THERMOELECTRIC COOLING FOR A REFRIGERATED DISPLAY CASE

BACKGROUND OF THE INVENTION

1. Field of the Invention

This invention relates generally to refrigerated display cases and, more particularly, to a method and apparatus for cooling in a refrigerated display case.

2. Description of the Related Art

In contemporary supermarket display cases which are open-faced, a cold air curtain or air flow is provided over the open-face in order to contain the cold air inside the case, and to protect the front merchandise from exposure to warm ambient air. A significant amount of mixing occurs along the air curtain as it flows downward over the open-face of the display case, resulting in infiltration of warm store air into the case and the displacement of an equal amount of cold air out of the case and into the store aisles. This results in a fairly inefficient operation of the store refrigeration system, as well as uncomfortable store aisle conditions for shoppers.

Other contemporary devices have attempted to reduce the mixing along the cold air curtain. However, such efforts have still allowed a significant amount of mixing to occur at the air curtain interface, resulting in a large amount of cold air leaving the display cases and decreasing the efficiency of the vapor-compression refrigeration system that is used to generate the cold air curtain.

Accordingly, there is a need for a refrigeration display case that improves the efficiency of the operation of the display case. There is a further need for reducing the amount of cold air that leaves the display case. The method and apparatus of the present invention recovers some of the lost energy through the use of a thermoelectric heat pump or cooler.

It is an object of the present invention to provide a thermoelectric heat pump for a refrigerant display case that reduces capacity and energy consumption of the store vapor-compression system.

It is a further object of the present invention to provide such a thermoelectric heat pump that reduces capital cost for the vapor-compression mechanical equipment.

It is yet a further object of the present invention to provide a configuration that allows for more optimal operation of the thermoelectric heat pump at a lower temperature differential (DT) using cold spill air.

It is another further object of the present invention to provide such a thermoelectric heat pump for a refrigerant display case that improves store aisle conditions for shoppers.

It is yet another object of the present invention to provide such a thermoelectric heat pump for a refrigerant display case that reduces the potential for condensation at the base of the display cases.

It is yet another further object of the present invention to provide such a thermoelectric heat pump for a refrigerant display case that lowers the evaporator load and defrost requirements.

SUMMARY OF THE INVENTION

In one aspect, a method of cooling a display case having an open face is provided, which comprises providing air flow across the open face; directing a first portion of the air flow into an air return in fluid communication with a vapor-compression refrigeration system; providing a thermoelectric heat pump in fluid communication with the first portion; cooling the first portion with the thermoelectric heat pump; returning the first portion to the vapor-compression refrigeration system for cooling; and returning the first portion to the air flow across the open face. The thermoelectric heat pump may be either in direct fluid communication with the first portion of the airflow or through a secondary heat exchange device.

In another aspect, a refrigeration system operably connected to a display case having an open face is provided. The refrigeration system comprises a primary refrigeration system that provides an air flow across the open face, with the air flow being cooled by the primary refrigeration system, and the air flow comprising a first portion of air flow that is returned to the primary refrigeration system and a second portion of air flow that is released from the display case. The refrigeration system further comprises a thermoelectric heat pump in fluid communication with the first portion of air flow for cooling the first portion prior to the first portion being returned to the primary refrigeration system.

In yet another aspect, a refrigerated display case is provided, which comprises a support structure having an open face, a vapor-compression refrigeration system and a thermoelectric heat pump. The vapor-compression refrigeration system provides an air flow across the open face. The air flow is cooled by the vapor-compression refrigeration system. The air flow comprises a first portion of air flow that is returned to the vapor-compression refrigeration system and a second portion of air flow that is released from the display case. The thermoelectric heat pump is in fluid communication with the first portion of air flow for cooling the first portion prior to the first portion being returned to the vapor-compression refrigeration system.

The method can further comprise directing the first portion of the air flow into thermal contact with a cold side of the thermoelectric heat pump. The method may further comprise directing a second portion of the air flow into thermal contact with a warm side of the thermoelectric heat pump. The second portion of the air flow can be released from the display case.

The primary refrigeration system can be a vapor-compression refrigeration system. The thermoelectric heat pump may comprise a cold side, wherein the cold side is in fluid communication with the first portion of air flow. The cold side of the thermoelectric heat pump can at least partially define a return opening that is in fluid communication with the primary refrigeration system. The thermoelectric heat pump may further comprise a warm side, wherein the warm side is in fluid communication with the second portion of air flow.

The refrigeration system can further comprise a fan for drawing the first portion of air flow through the return opening. The support structure can have a sill at a lower portion thereof and the thermoelectric heat pump can be in proximity to the sill. The refrigeration system or display case can further comprise a first heat exchanger in thermal communication with the cold side of the thermoelectric heat pump and the first portion of air flow and/or a second heat exchanger in thermal communication with the warm side of the thermoelectric heat pump and the second portion of air flow.

The above-described and other features and advantages of the present disclosure will be appreciated and understood by those skilled in the art from the following detailed description, drawings, and appended claims.

DETAILED DESCRIPTION OF THE INVENTION

Figure 1:
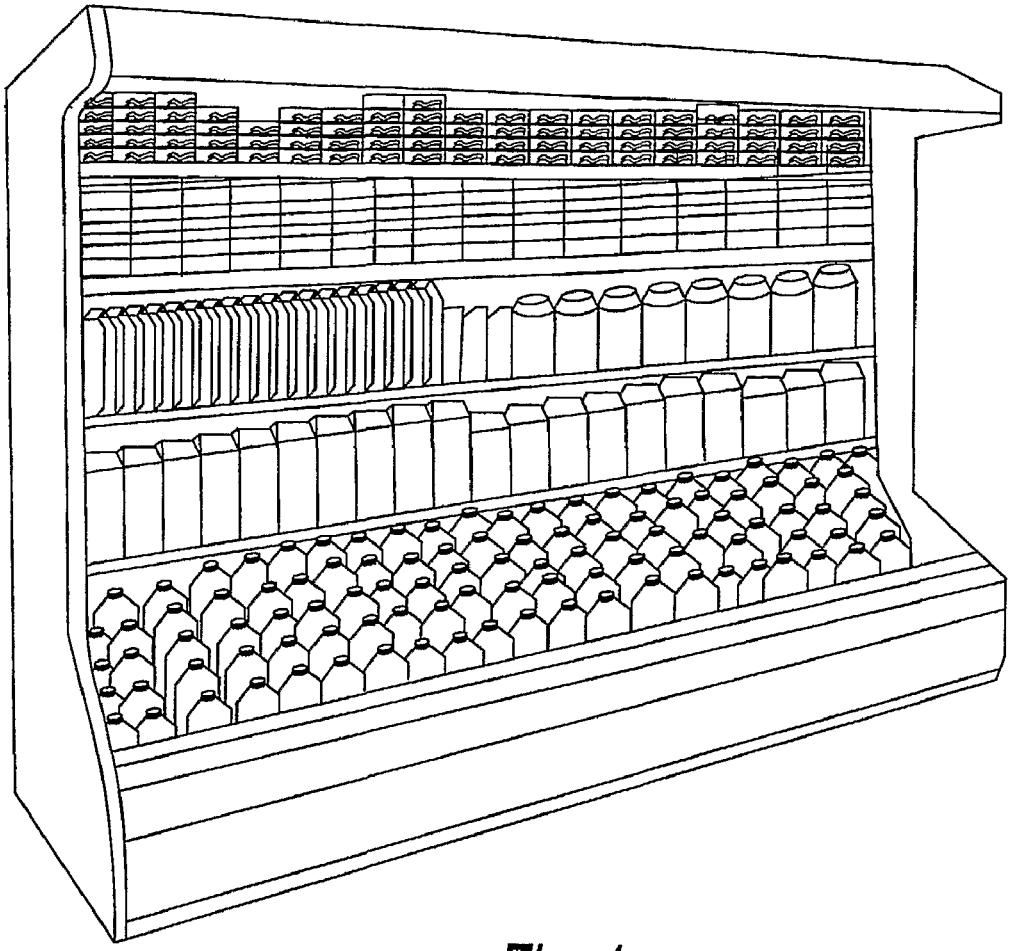
Fig. 1 (Prior Art)
FIG. 1 is a perspective view of a contemporary open-faced refrigerator display case.
Figure 2:
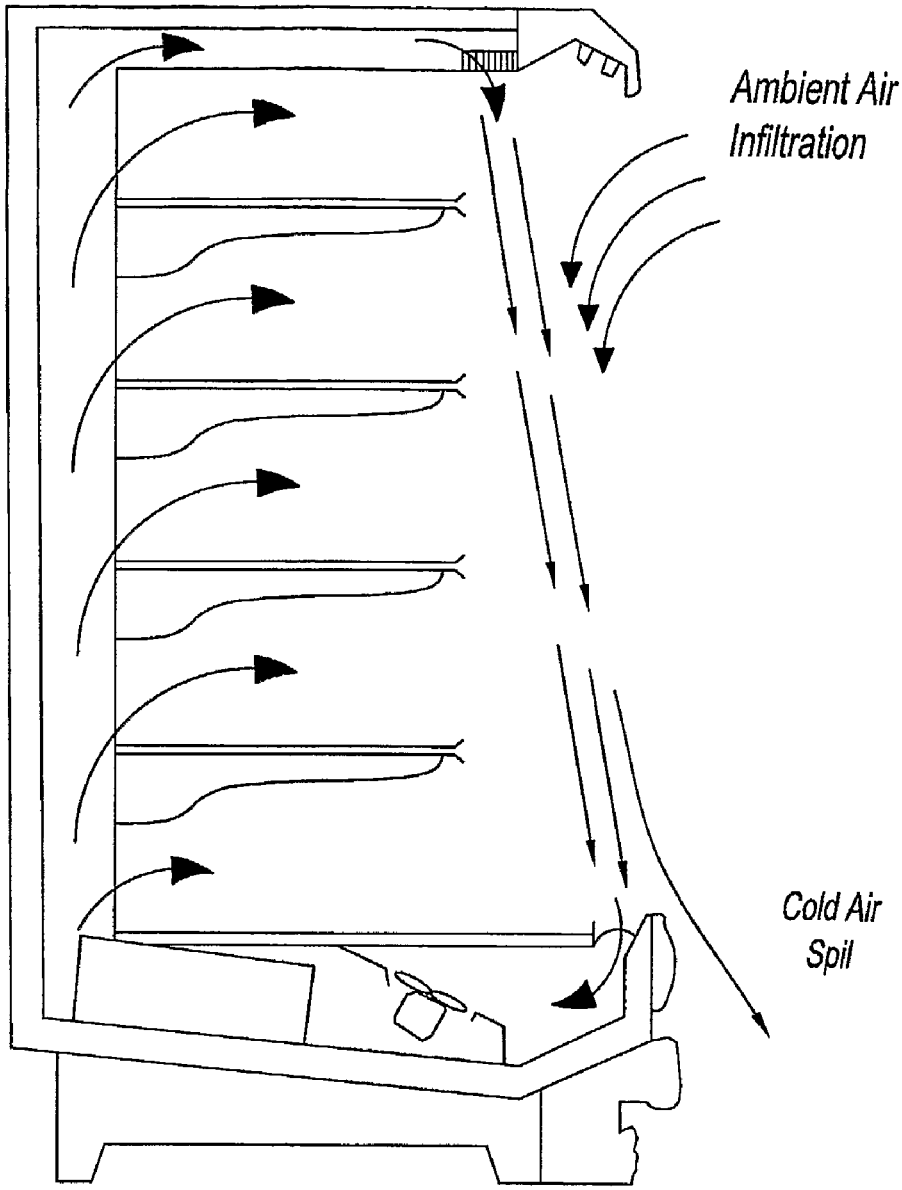
Fig. 2 (Prior Art)
FIG. 2 is a schematic cross-sectional illustration of the open-faced refrigerator display case of FIG. 1 showing the cold air curtain generated by the vapor-compression refrigeration system.
Figure 3:
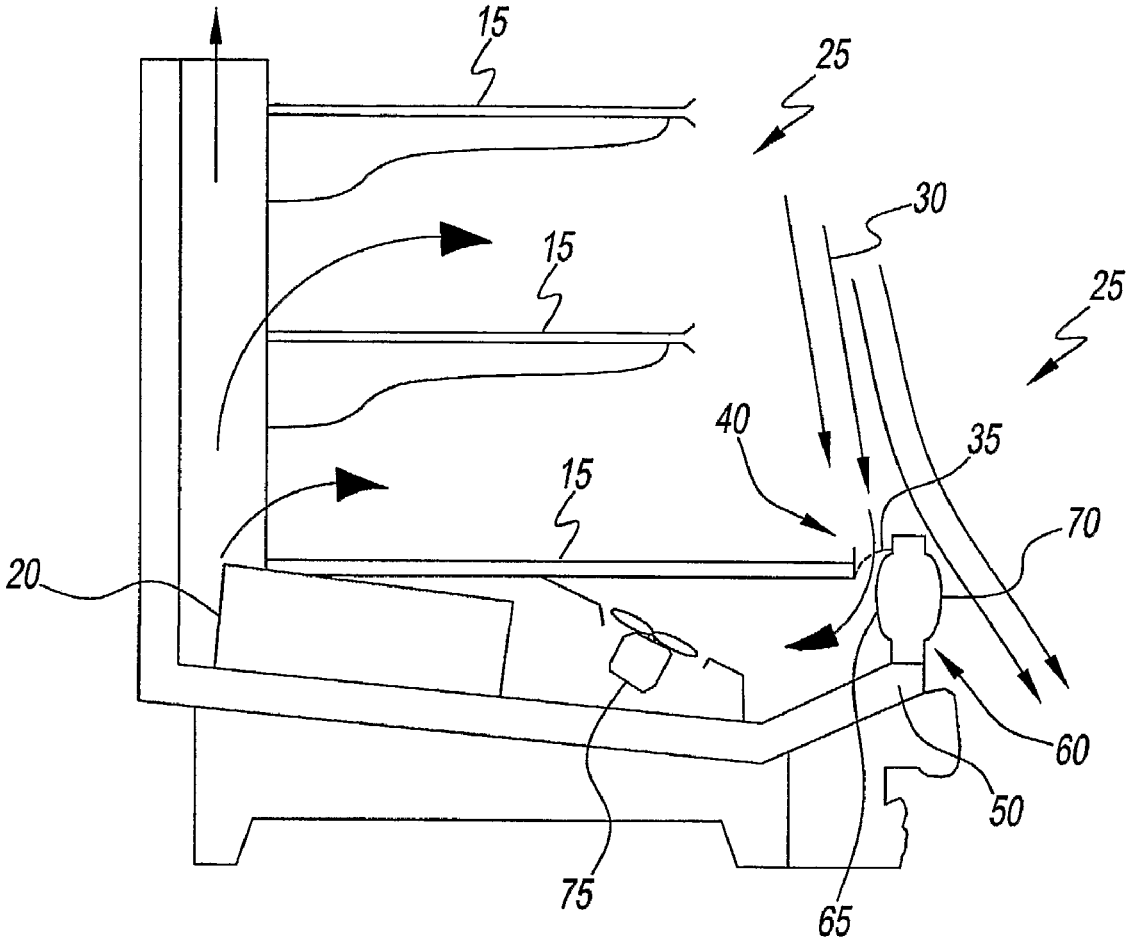
FIG. 3 is a schematic cross-sectional illustration of an open-faced refrigerator display case of an exemplary embodiment of the present invention.

Referring now to FIG. 3, an exemplary embodiment of a refrigerated display case generally referred to by reference numeral 10 is illustrated. Case 10 stores a refrigerated food product, or other such refrigerated item, on shelves 15 or other such support or holding structures. A vapor-compression system 20, or other primary refrigeration system, provides a cold air curtain 30 across or along an open-face 25 of the display case 10 in order to contain the cold air inside the display case, and to protect the front merchandise from exposure to warm ambient air. The cold air curtain 30 separates into a return air path or stream 40 and a spill air path or stream 45 near the front sill 50 of the display case 10.

A thermoelectric heat pump or cooler 60 is positioned so as to be in thermal and/or fluid communication with both the return air path 40 and the spill air path 45. In the exemplary embodiment, the thermoelectric heat pump 60 is positioned between the return air path 40 and the spill air path 45 so as to be in direct thermal contact. This position is along the front sill 50 of the display case 10 adjacent to a return opening 35. However, for alternative structures and designs for the display case 10, particularly where the return air path 40 is configured differently, the positioning of the thermoelectric heat pump 60 may differ.

The vapor-compression system 20 includes typical components to provide for refrigeration of the display case 10, not all of which are shown, including various valves, pipes or tubing, a compressor, a condenser, an evaporator and appropriate joining junctions. In the exemplary embodiment, a fan 75 or other vacuum device is positioned along the return air path 40 and feeds the vapor-compression system 20. However, the particular positioning and configuration of the vapor-compression system 20 can be varied according to the particular requirements of the system. The display case 10 has a return opening 35, which places the air along the return air path 40 in fluid communication with the fan 75 and the vapor-compression system 20.

The thermoelectric heat pump 60 has a cold side 65 and a warm side 70. The cold side 65 faces towards the inside of the display case 10, while the warm side 70 faces outwardly from the display case. With this position or configuration, the cold side 65 further cools the return air path 40 (in addition to the cooling that will be provided by the vapor-compression system 20), while the warm side is cooled by the spill air path 45.

The cooling of the return air path 40 by the cold side 65 reduces the load on the evaporator of the vapor-compression system 20, which reduces the overall required capacity of the vapor-compression refrigeration system. Additionally, defrosting requirements for the evaporator of the vapor-compression system 20 will also be reduced due to the partial condensation of moisture in the return air path 40 on the surface of the thermoelectric heat pump 20.

Due to the relatively small difference in temperature between the return air path 40 and the spill air path 45, the thermoelectric heat pump 60 operates across a relatively small differential temperature (DT). The coefficient of performance (COP) of the thermoelectric heat pump is inversely proportional to the differential temperature:

$$COP=T_c/DT$$

where $T_c$ is the cold face or side temperature. Currently, thermoelectric heat pumps suffer from the drawback of a low COP, which has held back their commercial implementation. However, by configuring or positioning the thermoelectric heat pump 60 between the return air path 40 and the spill air path 45 (or otherwise providing for such thermal communication), which typically have temperatures of approximately 41° F. and 55° F., respectively, so as to provide a relatively small differential temperature, the exemplary embodiment overcomes this shortcoming of thermoelectric heat pumps. The above temperatures are representative of typical medium-temperature display cases. However, the present invention as shown with respect to the exemplary embodiment is also applicable to low-temperature or freezer type display cases, as well as other display cases having different temperature requirements.

The particular type, including materials, dimensions and shape, of the thermoelectric heat pump or cooler 60 that is utilized can vary according to the particular needs of the display case 10. Preferably, the dimensions and shape of the cold side 65 and the warm side 70 maximize thermal contact, e.g., surface area, between the return air path 40 and the cold side, as well as between the spill air path 45 and the warm side. In the exemplary embodiment, the thermoelectric heat pump 60 and, in particular, the cold side 65 partially defines the return opening 35 to facilitate the thermal and fluid communication between the return air path 40 and the cold side of the thermoelectric heat pump.

Figure 4:
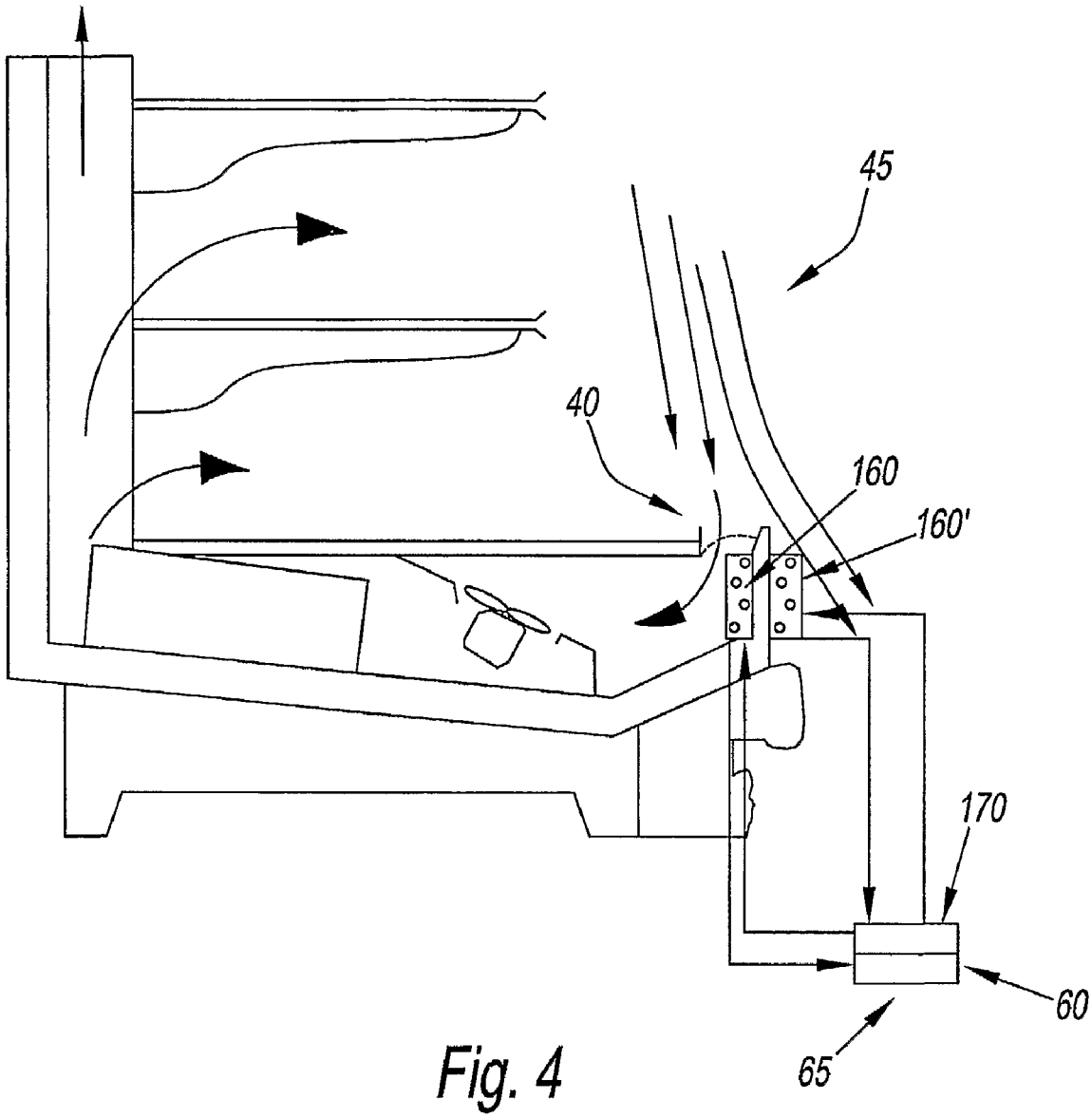
FIG. 4 is a schematic cross-sectional illustration of an open-faced refrigerator display case of another exemplary embodiment of the present invention.

Referring to FIG. 4, the thermoelectric heat pump 60 can also be placed in thermal communication with the return air path 40 and the spill air path 45 through use of one or more heat exchangers 160 (and 160'), as compared to the direct thermal contact of the exemplary embodiment of FIG. 3. In this alternative embodiment of FIG. 4, similar features as to the previous embodiment are denoted by the same reference numerals.

The cold side 65 of the thermoelectric heat pump 60 is in thermal communication with a first heat exchanger 160, while the warm side 70 of the thermoelectric heat pump is in thermal communication with a second heat exchanger 160'. The first and second heat exchangers 160 and 160' are respectively in direct thermal contact with the return air path 40 and the spill air path 45. The particular type, including materials, dimensions and shape, as well as the positioning and number, of the heat exchangers 160 and 160' that are utilized can vary according to the particular needs of the display case 10. Preferably, the positioning, dimensions and shape of the heat exchangers 160 and 160' maximize thermal contact, e.g., surface area, with the cold side 65, the warm side 70, the return air path 40 and the spill air path 45. The heat exchangers 160 and 160' may include heat exchange mediums, such as, for example, flowing liquids, refrigerants or the like, which increase the efficiency of the heat exchange.

In the embodiment of FIG. 4, the thermoelectric heat pump 60 cools a liquid stream that is pumped through the liquid-to-air heat exchanger 160 that is in thermal contact with the return air stream 40. The heat is rejected by the thermoelectric heat pump 160 to a hot (waste) liquid stream that is pumped through the second liquid-to-air heat exchanger 160' in thermal contact with the spill air stream 45. The heat is ultimately rejected to the spill air stream 45.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A method for cooling a display case (10) having an open face (25) comprising:

providing air flow (30) across the open face (25);

directing a first portion (40) of said air flow (30) into an air return (35) in fluid communication with a vapor-compression refrigeration system (20);

providing a thermoelectric heat pump (60) in thermal communication with said first portion (40);

cooling said first portion (40) with said thermoelectric heat pump (60);

rejecting heat from said first portion (40) via a first heat exchanger (160) in thermal communication with a cold side (65) of said thermoelectric heat pump (60);

rejecting the heat into a second portion (45) of said air flow (30) via a second heat exchanger (160') in thermal communication with a warm side (70) of the thermoelectric heat pump (60);

returning said first portion (40) to said vapor-compression refrigeration system (20) for cooling; and returning said first portion (40) to said air flow (30) across the open face (25).

2. The method of claim 1, further comprising directing said first portion (40) of said air flow (30) into thermal contact with the cold side (65) of said thermoelectric heat pump (60).

3. The method of claim 2, further comprising directing said second portion (45) of said air flow (30) into thermal contact with the warm side (70) of said thermoelectric heat pump (60).

4. The method of claim 3, wherein said second portion (45) of said air flow (30) is released from said display case (10).

5. A refrigeration system operably connected to a display case (10) having an open face (25), the system comprising:

a primary vapor-compression refrigeration system (20) that provides an air flow (30) across the open face (25), said air flow (30) being cooled by said primary refrigeration system (20), said air flow (30) comprising a first portion (40) of air flow (30) that is returned to said primary refrigeration system (20) and a second portion (45) of air flow (30) that is released from the display case (10);

a thermoelectric heat pump (60) in thermal communication with said first portion (40) of air flow (30) for cooling said first portion (40) prior to said first portion (40) being returned to said primary refrigeration system (20), the thermoelectric heat pump (60) including:

a cold side (65) in thermal communication with said first portion (40) of air flow (30); and a warm side (70) in thermal communication with said second portion (45) of air flow (30); and first and second heat exchangers (160, 160'), wherein said first heat exchanger (160) is in thermal communication with said cold side (65) of said thermoelectric heat pump (60) and said first portion (40) of air flow (30), and wherein said second heat exchanger (160') is in thermal communication with said warm side (70) of said thermoelectric heat pump (60) and said second portion (45) of air flow (30).

6. The system of claim 5, wherein said cold side (65) of said thermoelectric heat pump (60) at least partially defines a return opening (35) that is in fluid communication with said primary refrigeration system (20).

7. The system of claim 6, further comprising a fan (75) for drawing said first portion (40) of air flow (30) through said return opening (35).

8. A refrigerated display case (10) comprising:

a support structure (15) having an open face (25);

a vapor-compression refrigeration system (20) that provides an air flow (30) across said open face (25), said air flow (30) being cooled be said vapor-compression refrigeration system (20), said airflow (30) comprising a first portion (40) of air flow (30) that is returned to said vapor-compression refrigeration system (20) and a second portion (45) of air flow (30) that is released from said display case (10);

a thermoelectric heat pump (60) in fluid communication with said first portion (40) of air flow (30) for cooling said first portion (40) prior to said first portion (40) being returned to said vapor-compression refrigeration system (20), the thermoelectric heat pump (60) including:

a cold side (65) in thermal communication with said first portion (40) of air flow (30); and a warm side (70) in thermal communication with said second portion (45) of air flow (30); and first and second heat exchangers (160, 160'), wherein said first heat exchanger (160) is in thermal communication with said cold side (65) of said thermoelectric heat pump (60) and said first portion (40) of air flow (30), and wherein said second heat exchanger (160') is in thermal communication with said warm side (70) of said thermoelectric heat pump (60) and said second portion (45) of air flow (30).

9. The display case (10) of claim 8, wherein said support structure (15) has a sill (50) at a lower portion thereof, and wherein said thermoelectric heat pump (60) is in proximity to said sill (50).

10. The display case (10) of claim 8, wherein said cold side (65) of said thermoelectric heat pump (60) at least partially defines a return opening (35) that is in fluid communication with said vapor-compression refrigeration system (20).

11. The display case (10) of claim 10, further comprising a fan (75) for drawing said first portion (40) of air flow (30) through said return opening (35).

* * * * *